US005845907A

United States Patent [19]

Wells

[11] Patent Number: 5,845,907

[45] Date of Patent: Dec. 8, 1998

[54] METHOD OF PLAYING A POKER GAME

[76] Inventor: Jeffrey M. Wells, 3166 Oak Creek Dr. East, Colorado Springs, Colo. 80906

[21] Appl. No.: 940,121

[22] Filed: Sep. 29, 1997

[51] Int. Cl.[6] ..... A63F 1/00

[52] U.S. Cl. ..... 273/292

[58] Field of Search ..... 273/292, 303, 273/305

[56] References Cited

U.S. PATENT DOCUMENTS 5,382,025 1/1995 Sklansky et al. ..... 273/292
5,489,101 2/1996 Moody ..... 273/292
5,718,430 2/1998 Aramapakul et al. ..... 273/292
5,725,216 3/1998 Jones ..... 273/292

*Primary Examiner*—William E. Stoll

[57] ABSTRACT

A poker variation game involving multiple wagers. Cards are dealt by the dealer, three cards face down to each player and three common cards dealt face down. Players inspect their cards and determine whether to fold, or upon which two of their three cards they wish to make a second bet. Players additionally have the option, under certain conditions, to ignore the discard rules completely and to immediately declare their hand a winner. All bets are ultimately resolved according to a preselected payout schedule.

16 Claims, 3 Drawing Sheets

25

PAYOUT SCHEDULE:

| | |
|---|---|
| Royal Flush | 1000 to 1 |
| Straight Flush | 250 to 1 |
| 4 of a Kind | 50 to 1 |
| Full House | 15 to 1 |
| Flush | 10 to 1 |
| Straight | 7 to 1 |
| 3 of a Kind (on the deal) | 5 to 1 |
| 3 of a Kind | 3 to 1 |
| Two Pair | 2 to 1 |
| Pair of 9's or Better | 1 to 1 |

METHOD OF PLAYING A POKER GAME

This Application claims the benefit of U.S. Provisional Application No. 60/029,508 filed on Oct. 28, 1996.

TECHNICAL FIELD

The present invention relates to a method for playing a poker variation card game involving multiple wagers. The game can be played with a standard deck of cards or by video machine technology in a casino or home environment. In particular, it relates to a method for playing a wagering game, wherein the game is a variation of stud poker and provides players with the opportunity to determine when and upon which cards second bets will be made. Further, the particular invention provides the improvement of giving the player the opportunity, under specified conditions, to ignore the discard rule and to immediately declare their hand a winner during the course of the game.

BACKGROUND ART

There are numerous wagering games used for gambling. Such games should be simple to understand, yet exciting to play, and should give the player the opportunity to determine when and upon which cards they will wager successive bets. Exciting play, the opportunity to determine when and upon which cards they will wager certain bets and, under certain conditions, the ability to ignore discard rules completely, all contribute to enhance the player's interest and enjoyment of the game.

Gambling games intended primarily for play in a casino setting, should provide players with an enhanced sense of participation and control, the opportunity to make decisions that affect the outcome of their wager, and a reasonable chance of winning, despite the odds being in favor of the casino or house. Wagering games that utilize the concept of common or community cards to complete a player's hand are known (See generally "Scarnes Encyclopedia of Games", John Scarne, Harper & Row, 1973. Wagering games, including wagering games for casino play, with multiple wagering opportunities are also known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game. See also U.S. Pat. No. 5,288,081 (to Breeding) which discloses that a player may make a wager at the beginning of a hand and then later retrieve a portion of the wager. Also, additional symbols may be added to the usual means of playing a game to increase wagering opportunities. This is disclosed in U.S. Pat. No. 5,098,107 (to Boylan et al.).

The desired attributes of wagering games outlined above are in large measure provided by the method and apparatus for a wagering game in accordance with the present invention. The game is uncomplicated, exciting and provides the opportunity for players to determine when and upon which cards they will wager second bets. Additionally the present invention provides, under certain conditions, that the player has the option to ignore the discard rules completely and to immediately declare their hand a winner.

SUMMARY OF THE INVENTION

The wagering game of the present invention is played with a single, standard fifty-two card poker deck and broadly involves the generally well recognized and accepted set of rules and procedures relative to stud and hold'em poker. The game method comprises each player making an initial bet or ante to participate in the game. Following the shuffle and cut, cards are dealt by a dealer, three down to each player and three down to the dealer.

Upon receiving three cards, the player first determines if the three cards dealt, before any discard, are of the same rank, i.e. are "three of a kind" and, therefore, qualify for the three of a kind exception, if the three cards are not of the same rank the player still has the option to either play or fold.

If the player believes that the player cannot make a winning hand, the player may place all three cards in the area marked "Fold" and surrender the player's initial ante or bet.

If the player wishes to continue to play the hand, the player must wager a second and additional bet, equal to the amount of the initial ante bet. The player must also select one card from the player's and place it in the area marked "Discard".

If the three cards dealt to the player, before any discard, are "three of a kind", the player may ignore the discard rules and not discard any card. Then, before the dealer has turned over the community cards, the player may turn the player's cards face up and declare an immediate "three of a kind" exception winner. The player will be immediately paid according to the pre-selected payout schedule and play on that player's hand shall be concluded.

If a player qualifying for the "three of a kind" exception declines to accept the immediate winning exception, the player may either play or fold in accordance with the method for any non-qualifying hand.

After all players have made their choice to either play or fold, the dealer will then turn the three common or community cards face up. The dealer will then examine each of the player's hands and determine the highest poker hand held by each player when the player's two remaining cards are combined with the three community cards. The players are not playing against each other or against the dealer. The dealer then determines what payout, if any, each player is entitled to receive according to that player's wagers and the pre-selected payout schedule. Payouts are made to players with winning hands and the losing wagers are collected.

Apparatus is disclosed for playing the wagering game according to the method outlined above. A typical gaming table, with a playing surface, is modified to include specific areas that provide locations for placing the wagers, folded hands, discards, and for displaying the common cards. A card shuffling machine may be used but is not required. A display devise may be associated with the apparatus for displaying game information.

It is an object of the present invention to provide an exciting and interesting wagering game that is easy to learn, and that is largely based on stud and hold'em poker principals.

It is another object of the present invention to provide a new variation and improvement to known wagering games, by providing the player with BOTH the opportunity to determine when and upon which cards second bets will be made and the opportunity, under certain conditions, to ignore discard rules completely and to declare their hand a winner during the course of the game.

Still another object of the present invention is to provide a wagering game that is easy to learn, yet demands skill of players in making strategic decisions about when and upon which cards to make second bets.

A further object of the present invention is to provide a unique, exciting card game for play in casinos or at home and on various media including casino tables, video poker machines, video lottery terminals or home computers.

DETAILED DESCRIPTION OF THE PREFERRED EMBODIMENT

Figure 1:
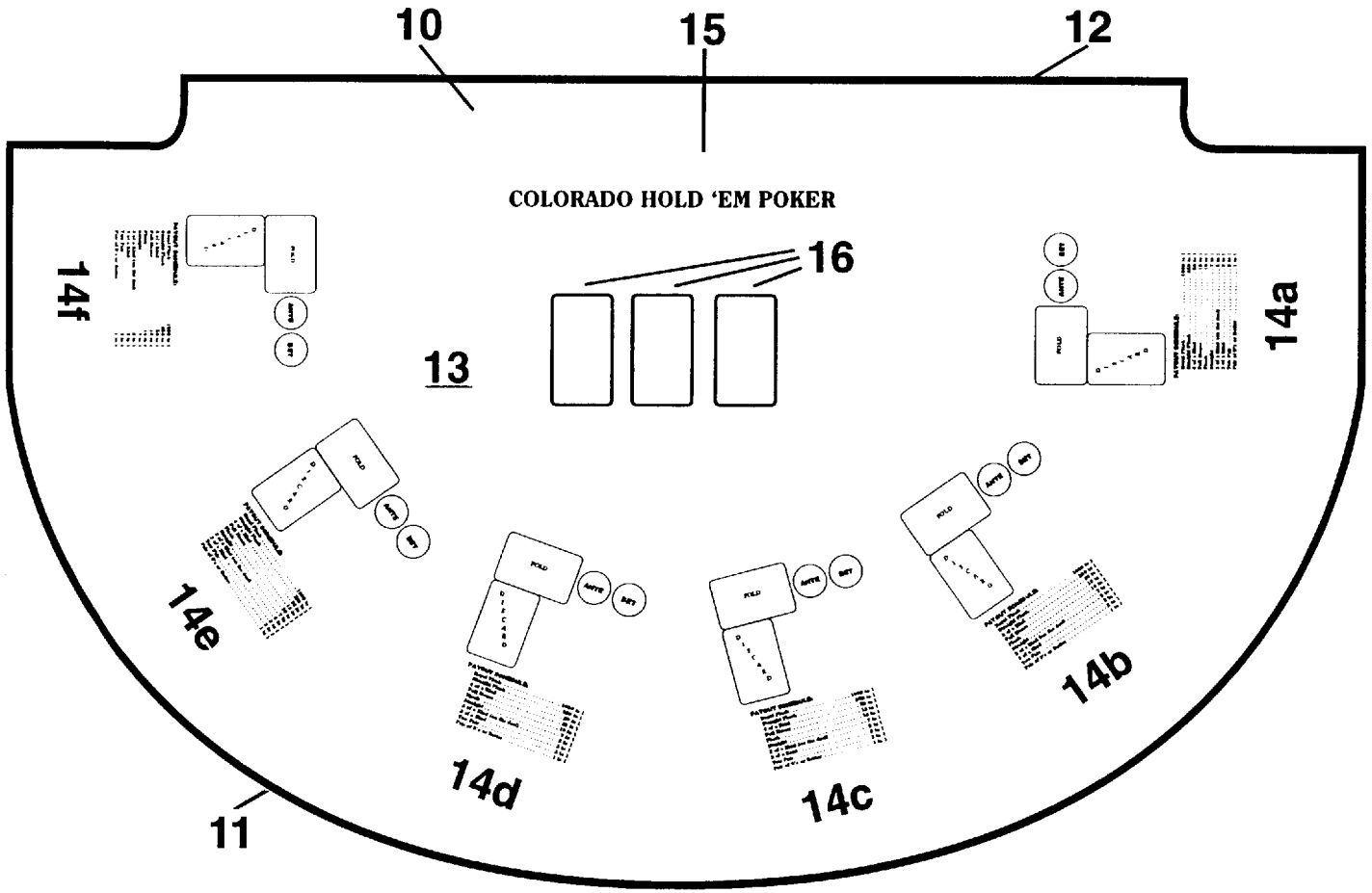
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 11 for accommodating up to six players and a straight side 12 for accommodating the dealer. The table 10 has a flat surface 13 covered with felt or other appropriate material. Although six playing positions or locations 14*a–f* for individual players are provided, it is not essential to the game that exactly six persons play and as many as sixteen players may participate. For casino play, a maximum of six players provides for a game that is easily manageable by the dealer and house, and one in which the individual players feel more involved. A house dealer position 15, including an area suitable for displaying the dealer's cards 16, is provided.

Figure 2:
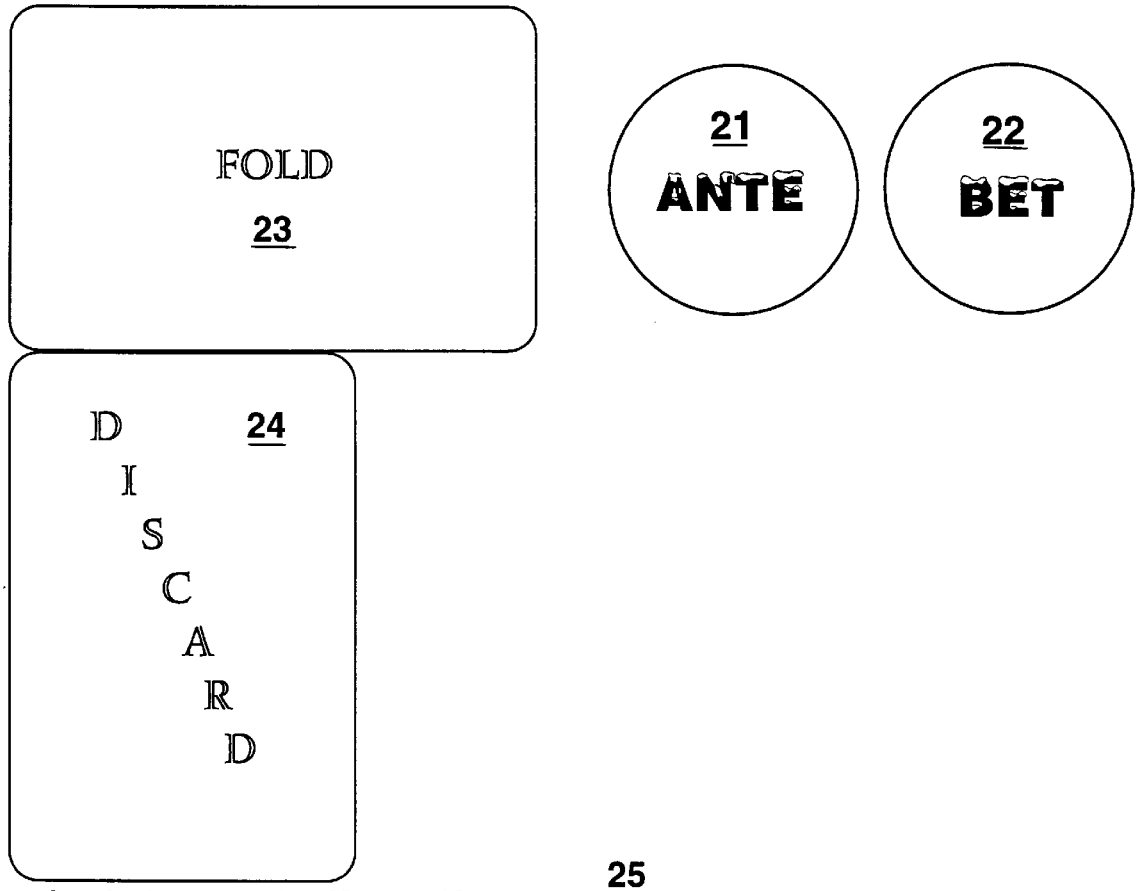
FIG. 2 depicts an individual player's game board on the table layout.

Referring to FIG. 2, the player's game board consists of two separate and distinct wagering or betting areas, the Ante 21 and the Bet 22. Each player position also includes an area for the player to "Fold" 23 or to "Discard" 24, and a printed pre-selected payout schedule 25.

Figure 3:
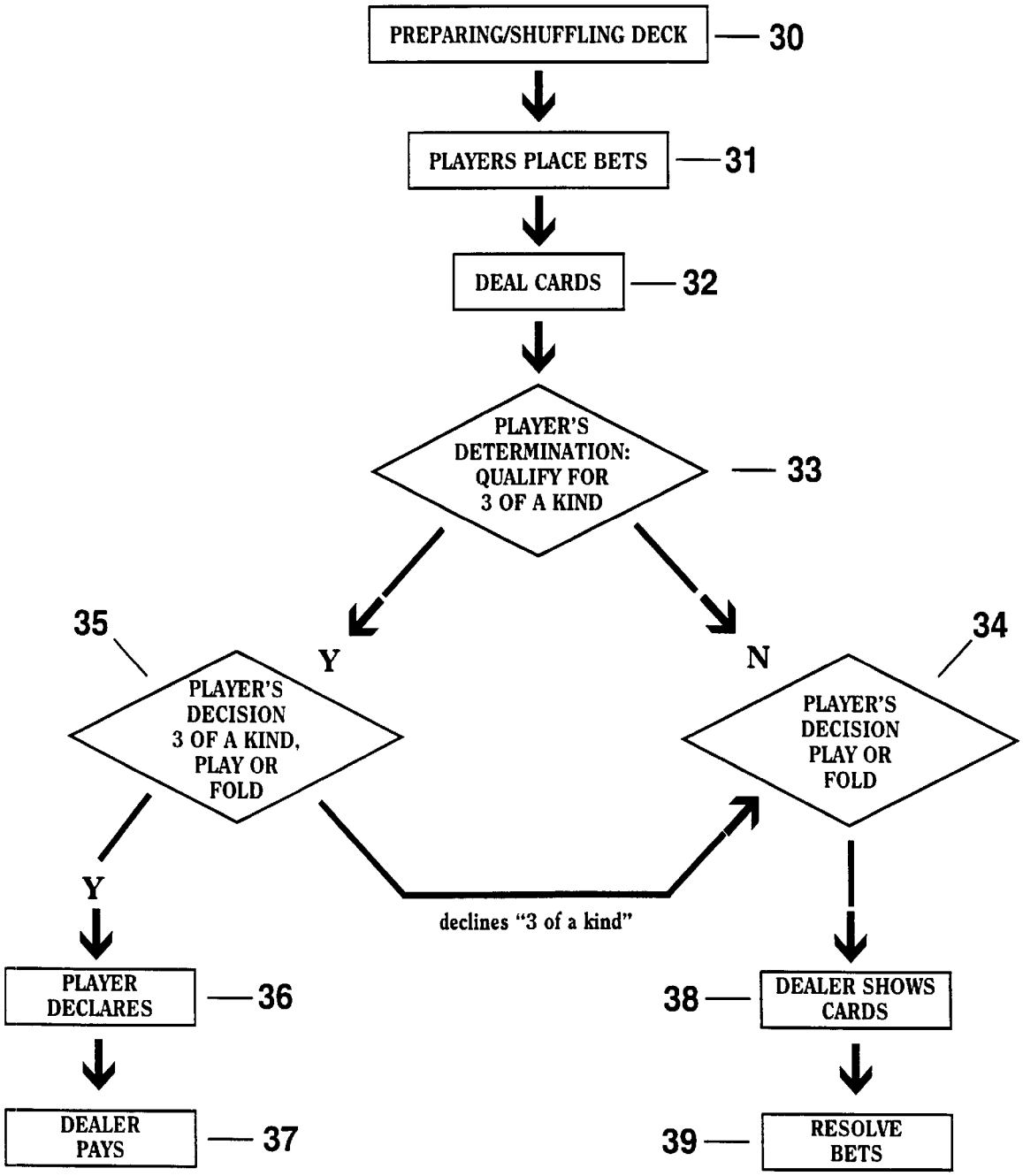
FIG. 3 is a block diagram representing the flow of play in the game.

Referring to the flow diagram of FIG. 3, the initial step in playing the game of the present invention is preparing or shuffling a deck of cards represented at block 30. Next, each player will make an initial wager, block 31, by placing a bet in the betting area marked "Ante", 21, on the player's game board. After the placing of the wager by each player, the cards are dealt, block 32, three cards being dealt down to each player and three cards are dealt down in front of the dealer in area 16.

Upon receiving the three cards, the player first determines if the three dealt cards, before any discard, are of the same rank and qualify for the "three of a kind" exception, block 33.

If the player's three cards are not of the same rank and the hand does not qualify for the "three of a kind" exception, then the player has the option to either play or fold, as represented in block 34. If the player believes that the player cannot make a winning hand, the player may place all three cards in the card area marked "Fold", 23, and surrender the player's ante, 21. If the player wishes to continue to play the hand, the player must wager a second and additional bet, equal to the amount of the initial ante bet, in the area marked "Bet", 22. The player must also select one card from the player's hand and place it in the area marked "Discard", 24.

If the three cards dealt to the player, before any discard are "three of a kind", block 35, the player has, by way of improvement, the option to ignore the discard rules and not discard any card. Then, before the dealer has turned over the community cards, the player may turn the player's cards face up and declare an immediate "three of a kind" exception winner, block 36. The player will be immediately paid according to the pre-selected payout schedule, 25, and play on that player's hand shall be concluded, block 37.

If a player qualifying for the "three of a kind" exception, block 35, declines to accept the immediate winning "three of a kind" exception, then the player may either play or fold, block 34, in accordance with the method for any non-qualifying hand.

After all players have made their choice to either play or fold, the dealer will then turn the three common or community cards face up, block 38. The dealer will then examine each of the player's hand and determine the highest poker hand held by each player when the player's two remaining cards are combined with the three community cards. The players are not playing against each other or against the dealer. The dealer then determines what payout, if any, each player is entitled to receive according to that player's wagers and the preselected payout schedule. Payouts are made to the players with winning hands and the losing wagers are collected, block 39.

The hand is then over and the flow of the game returns to block 30, preparing and shuffling the deck for a new hand.

A typical payout schedule would be as follows:

Royal Flush 1000 to 1

Straight Flush 50 to 1

4 of a Kind 50 to 1

Full House 15 to 1

Flush 10 to 1

Straight 7 to 1

3 of a Kind (on the deal) 5 to 1

3 of a Kind 3 to 1

Two Pair 2 to 1

Pair of 9's or Better 1 to 1

The method of the present invention is not limited to one type of poker game, but may be applied or used in any five, six or seven card poker game. The method of the present invention might be played live in casinos with a dealer, or in casinos or other places by video machine technology or other interactive device.

What is claimed is:

1. A method of playing a poker variation card game involving multiple wagers using a single standard deck of cards, with said game involving standard poker hand rankings and comprising the steps of:

each player placing a wager to participate in the game;

a dealer dealing cards face down to each player and at least one common card face down for use by all participating players;

giving each participating player the chance, before any discard, to inspect the cards the player received to determine if the cards qualify for the discard exception under certain specified conditions;

restricting all participating players whose initial cards do not qualify for the discard exception to the option to either play or fold;

requiring all players who wish to continue to play a hand to discard one of their cards and to make a second bet;

giving each player whose initial cards do qualify for the discard exception, the standard option to either fold or to discard and play, as well as the improved option to ignore the discard rules and declare the hand an immediate winner;

showing the common card(s) and determining the highest poker hand held by each player;

determining what payout, if any, each player is entitled to receive according to that player's wagers and the pre-selected payout schedule.

2. The method according to claim 1, wherein players whose initial cards qualify for the discard exception are allowed to keep all three initial cards without discard.

3. The method according to claim 2, wherein the player having declared an exception winner is paid without requiring and without allowing any additional wager on the hand.

4. The method according to claim 2, wherein the player having declared an exception winner is paid without allowing any of the player's initial cards to be combined with the common card(s) for that hand.

5. The method according to claim 2, wherein the player having declared an exception winner will be immediately paid by the dealer during the course of the hand.

6. The method according to claim 1, wherein players whose initial cards qualify for the discard exception are allowed to declare their hand an immediate winner.

7. The method according to claim 1, wherein the participating players are not playing against each other or against the dealer.

8. The method according to claim 1 and providing apparatus for playing the game, said apparatus including a playing surface having wager receiving areas, fold and discard areas, and a common card-receiving area for receiving and showing the three common cards.

9. A method of playing a poker variation card game involving multiple wagers using a single standard deck of cards, with said game involving standard poker hand rankings and comprising the steps of:

each player placing a wager to participate in the game;

a dealer dealing three cards face down to each player and three common cards face down for use by all participating players;

giving each participating player the chance, before any discard, to inspect the three cards the player received to determine if all three cards are of the same rank, i.e. "three of a kind";

restricting all participating players whose initial three cards are not of the same rank and, therefore, do not qualify for the "three of a kind" discard exception to the option to either play or fold;

requiring all players who wish to continue to play a hand to discard one of their three cards and to make a second bet;

giving each player whose initial three cards are of the same rank, the standard option to either fold or to discard and play, as well as the improved option to ignore the discard rules and declare the hand an immediate winner;

showing the three common cards and determining the highest poker hand held by each player when the player's two remaining cards are combined with the three community cards;

determining what payout, if any, each player is entitled to receive according to that player's wagers and the pre-selected payout schedule.

10. The method according to claim 9, wherein players whose initial three cards are of the same rank are allowed to keep all three initial cards without discard.

11. The method according to claim 10, wherein the player having declared a "three of a kind" winner is paid without requiring and without allowing any additional wager on the hand.

12. The method according to claim 10, wherein the player having declared a "three of a kind" winner is paid without allowing any of the player's initial three cards to be combined with the common cards for that hand.

13. The method according to claim 10, wherein the player having declared a "three of a kind" winner will be immediately paid by the dealer during the course of the hand.

14. The method according to claim 9, wherein players whose initial three cards are of the same rank are allowed to declare the hand an immediate winner.

15. The method according to claim 9, wherein the participating players are not playing against each other or against the dealer.

16. The method according to claim 9 and providing apparatus for playing the game, said apparatus including a playing surface having wager receiving areas, fold and discard areas, and a common card-receiving area for receiving and showing the three common cards.

* * * * *